US009366443B2

(12) United States Patent
Laster et al.

(10) Patent No.: US 9,366,443 B2
(45) Date of Patent: Jun. 14, 2016

(54) LEAN-RICH AXIAL STAGE COMBUSTION IN A CAN-ANNULAR GAS TURBINE ENGINE

(71) Applicant: SIEMENS ENERGY, INC., Orlando, FL (US)

(72) Inventors: Walter R. Laster, Oviedo, FL (US); Peter Szedlacsek, Winter Park, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 652 days.

(21) Appl. No.: 13/739,316

(22) Filed: Jan. 11, 2013

(65) Prior Publication Data

US 2014/0196465 A1 Jul. 17, 2014

(51) Int. Cl.

| | |
|---|---|
| ***F02G 3/00*** | (2006.01) |
| ***F23R 3/34*** | (2006.01) |
| ***F23R 3/28*** | (2006.01) |

(52) U.S. Cl.

CPC ..... *F23R 3/346* (2013.01); *F23R 3/286* (2013.01)

(58) Field of Classification Search

CPC ..... F23R 3/346; F23R 2/86
USPC ..... 60/39.39, 737, 776, 746
See application file for complete search history.

(56) References Cited

U.S. PATENT DOCUMENTS

| | | | | |
|---|---|---|---|---|
| 4,192,139 | A * | 3/1980 | Buchheim | F23R 3/346 60/39.826 |
| 5,020,479 | A | 6/1991 | Suesada | |
| 5,099,644 | A * | 3/1992 | Sabla | F23R 3/34 60/207 |
| 5,271,729 | A | 12/1993 | Gensler | |
| 6,192,688 | B1 * | 2/2001 | Beebe | F23L 7/00 60/723 |
| 7,047,748 | B2 * | 5/2006 | Zauderer | B01D 53/56 60/39.55 |
| 7,775,791 | B2 | 8/2010 | Swanson | |
| 2007/0130830 | A1 * | 6/2007 | Varatharajan | B01J 12/00 48/127.9 |
| 2008/0083224 | A1 | 4/2008 | Varatharajan | |
| 2010/0095649 | A1 * | 4/2010 | Blouch | F02C 7/22 60/39.463 |
| 2010/0170254 | A1 | 7/2010 | Venkataraman et al. | |
| 2011/0067402 | A1 | 3/2011 | Wiebe et al. | |
| 2011/0113787 | A1 * | 5/2011 | Milosavljevic | F23R 3/343 60/776 |
| 2011/0289928 | A1 * | 12/2011 | Fox | F23R 3/286 60/740 |

FOREIGN PATENT DOCUMENTS

| | | | |
|---|---|---|---|
| CN | 101629719 | A | 1/2010 |
| CN | 101839177 | A | 9/2010 |
| DE | 2629761 | A | 1/2006 |
| DE | 102009025812 | A1 | 1/2010 |
| DE | 102009026400 | A1 | 4/2010 |
| EP | 2071240 | A1 | 6/2009 |
| EP | 2107311 | A1 | 7/2009 |
| EP | 2236938 | E2 | 6/2010 |
| EP | 2532968 | | 12/2012 |

* cited by examiner

*Primary Examiner* — Charles Freay

(57) ABSTRACT

An apparatus and method for lean/rich combustion in a gas turbine engine (10), which includes a combustor (12), a transition (14) and a combustor extender (16) that is positioned between the combustor (12) and the transition (14) to connect the combustor (12) to the transition (14). Openings (18) are formed along an outer surface (20) of the combustor extender (16). The gas turbine (10) also includes a fuel manifold (28) to extend along the outer surface (20) of the combustor extender (16), with fuel nozzles (30) to align with the respective openings (18). A method (200) for axial stage combustion in the gas turbine engine (10) is also presented.

19 Claims, 4 Drawing Sheets

LEAN-RICH AXIAL STAGE COMBUSTION IN A CAN-ANNULAR GAS TURBINE ENGINE

STATEMENT REGARDING FEDERALLY SPONSORED DEVELOPMENT

Development for this invention was supported in part by Contract No. DE-FC26-05NT42644 awarded by the United States Department of Energy. Accordingly, the United States Government may have certain rights in this invention.

FIELD OF THE INVENTION

The invention relates to can-annular gas turbine engines, and more specifically, to a combustion stage arrangement of a can-annular gas turbine engine.

BACKGROUND OF THE INVENTION

A conventional design for a midframe design of a can-annular gas turbine engine 110 is illustrated in FIG. 1. A compressor 111 directs compressed air through an axial diffuser 113 and into a plenum 117, after which the compressed air turns and enters a sleeve 122 positioned around a combustor 112. The compressed air is mixed with fuel from various fuel stages 119 of the combustor 112 and the air-fuel mixture is ignited at a stage 121 of the combustor 112. Hot combustion gas is generated as a result of the ignition of the air-fuel mixture, and the hot combustion gas is passed through the combustor 112 and into a transition 114, which directs the hot combustion gas at an angle into a turbine 115.

In conventional can-annular gas turbine engines, a lean air/fuel mixture is ignited at the stage 121 of the combustor 112. However, at high loads and high temperatures, various emissions, such as nitrous oxide (NOx), are generated within the hot combustion gas as a result of igniting the lean air/fuel mixtures, and these emissions may exceed legally permissible limits. Additionally, if a rich air/fuel mixture is ignited at the stage 121 of the combustor 112, the temperature of the generated combustion gas may not be sufficient to combust hydrocarbons present within the combustion gas and thus the hydrocarbons may also exceed legally permissible limits.

In addition to the conventional design discussed above, U.S. Pat. No. 6,192,688 to Beebe discloses a combustion stage arrangement in a gas turbine engine, in which a lean air-fuel mixture is injected into combustion gas at a downstream stage from an upstream stage where a lean air-fuel premixture is combusted to generate the combustion gas. Additionally, other combustion stage designs have also been proposed in U.S. Pat. No. 5,271,729 to Gensler et al. and U.S. Pat. No. 5,020,479 to Suesada et al. However, these designs are for non-gas turbine combustion arrangements.

In the present invention, the present inventors make various improvements to the combustion stage design of the can-annular gas turbine engine, to overcome the noted disadvantages of the conventional combustion stage design.

BRIEF DESCRIPTION OF THE DRAWINGS

The invention is explained in the following description in view of the drawings that show.

DETAILED DESCRIPTION OF THE INVENTION

The inventors have designed an axial combustion stage arrangement for a can-annular gas turbine engine which avoids the shortcomings of the conventional combustion stage arrangements. A lean-air fuel mixture is combusted at an initial upstream stage and a rich air-fuel mixture is injected and combusted at a subsequent downstream stage. The lean air-fuel mixture is combusted at the initial upstream stage to generate hot combustion gas at an initial temperature such that the emissions levels, including NOx, do not exceed impermissible thresholds. The rich air-fuel mixture is subsequently injected into the hot combustion gas at the downstream stage, such that the heat and the presence of free radicals from the lean combustion promote complete combustion of the hydrocarbons in the rich air-fuel mixture and the initial temperature of the hot combustion gas is elevated by a threshold amount such that the emission levels, including NOx, do not exceed impermissible thresholds.

Throughout this patent application, the terms "rich" and "lean" will be used to describe an air-fuel mixture. In terms of this patent application, a "rich" air-fuel mixture is one which has an equivalence ratio ( ) of greater than one, and a "lean" air-fuel mixture is one which has an equivalence ratio of less than one. As appreciated by one skilled in the art, the equivalence ratio is defined as a quotient of a fuel-air ratio of the air-fuel mixture and a fuel-air ratio of a stoichiometric reaction of the air-fuel mixture. Thus, if the equivalence ratio is less than one ("lean" air-fuel mixture), then there is a shortage of fuel, relative to the fuel required for the stoichiometric reaction between the air and the fuel. If the equivalence ratio is greater than one ("rich" air-fuel mixture), then there is an excess of fuel, relative to the fuel required for the stoichiometric reaction between the air and the fuel.

Figure 2:
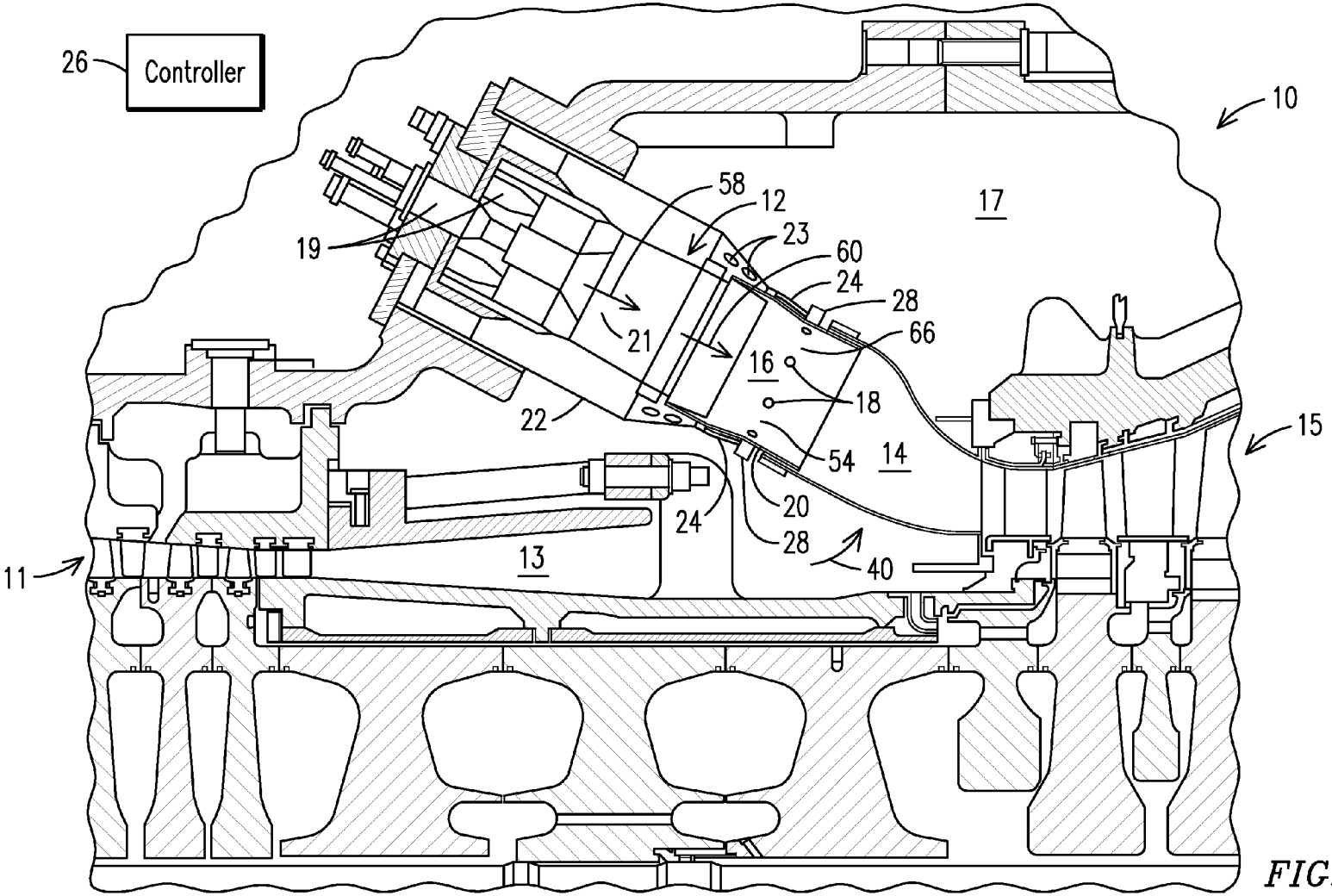
FIG. 2 is a cross-sectional view of an axial stage combustion arrangement in a gas turbine engine.

FIG. 2 illustrates an exemplary embodiment of a gas turbine engine 10 including a compressor 11 and a diffuser 13 which output a compressed air flow 40 into a plenum 17 of the gas turbine engine 10. The gas turbine engine 10 is a can-annular gas turbine engine, which features a plurality of combustors 12 arranged in an annular arrangement around a rotational axis (not shown) of the gas turbine engine 10. FIG. 2 illustrates one combustor 12 of the combustors in the annular arrangement. In an exemplary embodiment, sixteen combustors are arranged in this can-annular arrangement around the rotational axis. Although a can-annular gas turbine engine 10 is illustrated in FIG. 2, the embodiments of the present invention are not limited to can-annular gas turbine engines and may be employed in any gas turbine engine featuring axial stage combustion, such as annular gas turbine engines, for example.

FIG. 2 further illustrates a sleeve 22 positioned around an outer surface of the combustor 12, where the sleeve 22 includes openings 23 to receive a portion of the air flow 40 from the plenum 17. The air flow 40 is directed through the sleeve 22 and is mixed with fuel from fuel stages 19 to generate a lean air-fuel mixture 58 at a first stage 21 of combustion of the combustor 12. As previously discussed, the lean air-fuel mixture 58 is mixed such that the equivalence ratio of the mixture is less than one. In an exemplary embodiment, the equivalence ratio of the lean air-fuel mixture is 0.6. The lean air-fuel mixture 58 is ignited at the first stage 21 of combustion of the combustor 12, to create hot combustion gas 60 at a first temperature 62 (FIG. 4) and containing free radicals.

Figure 1:
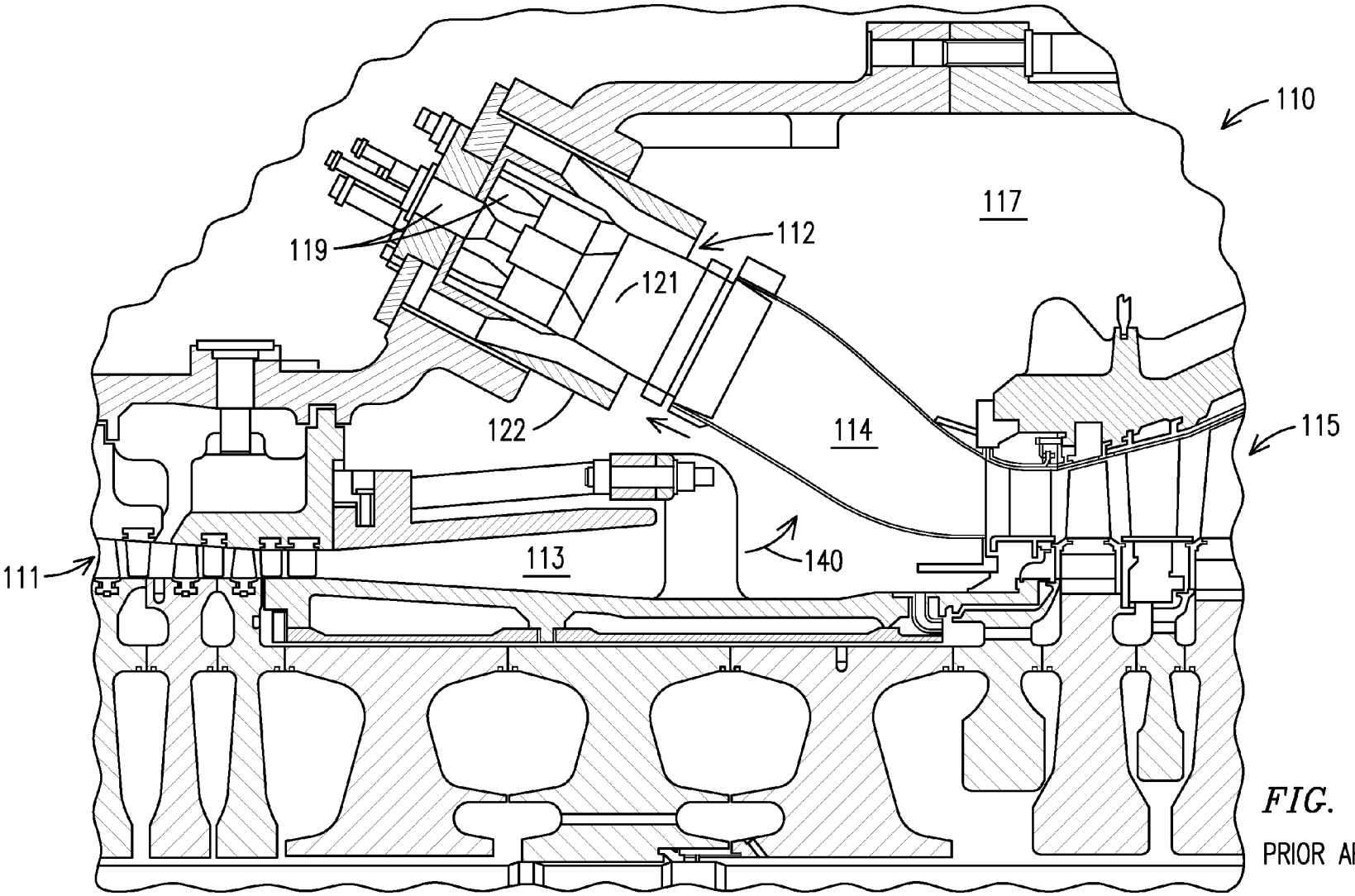
FIG. 1 PRIOR ART
FIG. 1 is a cross-sectional view of a prior art gas turbine engine.

FIG. 2 further illustrates a combustor extender 16 which is connected to a downstream end of the combustor 12, to receive the hot combustion gas 60 generated at the first stage 21 of combustion of the combustor 12. As discussed below, the combustor extender 16 features a second stage 66 of combustion, downstream from the first stage 21 of combustion of the combustor 21, such that an air-fuel mixture 44 (FIG. 3) is injected into the hot combustion gas 60 passing through the combustor extender 16 at the second stage 66. Additionally, a transition 14 is connected to a downstream end of the combustor extender 16, where the transition 14 has a shorter length than the conventional transition 114 used in the conventional gas turbine engine 110 of FIG. 1. In an exemplary embodiment, the combustor extender 16 and the transition 14 of the gas turbine 10 of FIG. 2 are used to collectively replace the conventional transition 114 of the conventional gas turbine engine 110 of FIG. 1.

An outer surface 20 of the combustor extender 16 features openings 18 which are formed along an outer circumference 54 of the outer surface 20. A fuel manifold 28 is provided, which takes the shape of a ring that extends around the outer circumference 54 of the outer surface 20. As illustrated in FIG. 2, fuel is supplied to the fuel manifold 28 from a fuel supply line 24 extending from within the sleeve 22 to the fuel manifold 28. As appreciated by one of skill in the art, the sleeve 122 of the conventional gas turbine engine 110 in FIG. 1 features a fuel supply line (not shown) that premixes fuel (sometimes referred to as C-stage fuel) with the air flow 140 received within the sleeve 122 from the plenum 117, before the air flow 140 is mixed with fuel from the fuel stages 119. In the gas turbine engine 10 of FIG. 2, the fuel supply line 24 within the sleeve 22 is instead directed out of the sleeve 22 to the fuel manifold 28, to supply fuel to the fuel manifold 28 at each of the openings 18. A controller 26 is provided to direct the fuel line supply line 24 to supply fuel to the fuel manifold 28, based on an operating parameter of the gas turbine engine 10 exceeding a predetermined limit, such as a power or a load demand of the gas turbine engine 10 exceeding a power or load threshold, for example.

Figure 3:
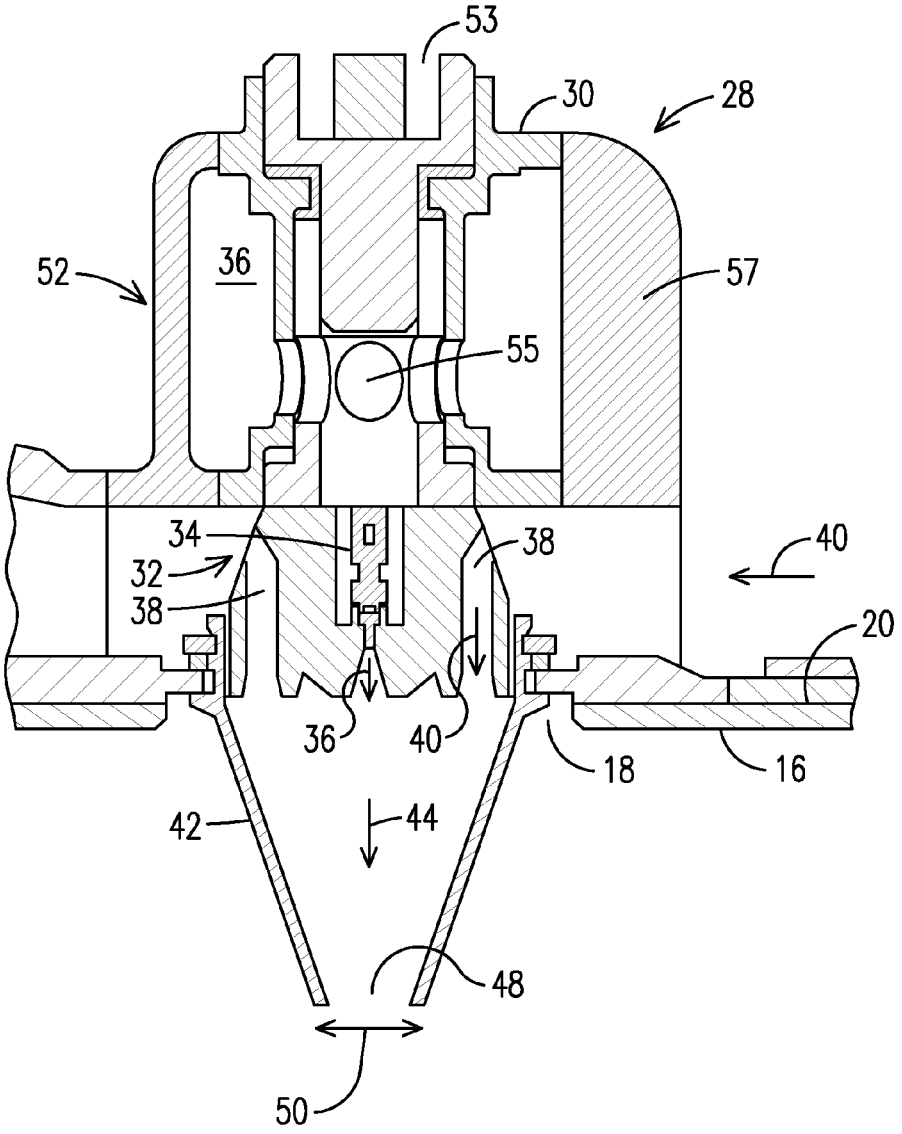
FIG. 3 is a cross-sectional view of a fuel manifold of the axial stage combustion arrangement of FIG. 2.

As illustrated in FIG. 3, at each of the openings 18 in the outer surface 20 of the combustor extender 16, the fuel manifold 28 includes a fuel nozzle 30 with a side cap 57. Although the opening 18 illustrated in FIGS. 2-3 is a circular-shaped opening, the opening 18 may be an oval-shaped opening or any other shape which accommodates the delivery of the air-fuel mixture into the combustor extender 16, as discussed below. As illustrated in FIG. 3, a mixer 32 is also provided at each of the openings 18, and is positioned between the fuel nozzle 30 and the opening 18. The mixer 32 includes a first opening 34, to receive fuel 36 from the fuel nozzle 30 of the fuel manifold 28 and a second opening 38, to receive a portion of the air flow 40 from the plenum 17 of the gas turbine engine 10. In an exemplary embodiment, the first opening 34 is positioned in a central cross-sectional region of the mixer 32, and the second opening 38 is an annular opening within the mixer 32. The fuel nozzle 30 includes a valve 52 to adjustably vary a volumetric flow rate of fuel 36 from the fuel nozzle 30 through the first opening 34 and into the mixer 32. As illustrated in FIG. 3, the valve 52 includes a screw 53 that is adjustable, to rotate an opening 55 to an open position, to permit fuel 36 to pass from the fuel manifold 28 through the opening 55 and into the first opening 34 of the mixer 32. The volumetric flow rate of the fuel 36 through the opening 55 and the first opening 34 of the mixer 32 can be adjustably varied, by adjusting the screw 53, which in-turn rotates the opening 55 relative to the fuel manifold 28. Additionally, the flow rate of the fuel 36 may be shut off from entering the opening 55 and the first opening 34 of the mixer 32, by adjusting the screw 53 so that the opening 55 is rotated to a closed position, such that fuel 36 from the fuel manifold 28 cannot enter the opening 55 or the first opening 34 of the mixer 32. As previously discussed, the fuel manifold 28 includes a fuel nozzle 30 at each of the respective openings 18, and the screws 53 of the fuel nozzles 30 may be simultaneously adjusted to the same degree for all fuel nozzles 30, to modify the flow rate of fuel 36 in each fuel nozzle 30 by the same extent. Alternatively, the screw 53 at each fuel nozzle 30 may be individually adjusted to individually adjust the flow rate of fuel 36 at each respective fuel nozzle 30, based on combustion tuning requirements of the second stage 66.

As further illustrated in FIG. 3, a scoop 42 receives the fuel 36 from an outlet of the first opening 34 and also receives the portion of the air flow 40 from an outlet of the second opening 38. The fuel 36 and the air flow 40 are mixed in the scoop 42, to form the rich air-fuel mixture 44, which has an equivalence ratio greater than one. The scoop 42 directs the rich air-fuel mixture 44 into the hot combustion gas 60 at the second stage of combustion 66 in the combustor extender 16. As illustrated in FIG. 3, the scoop 42 takes a conical shape that is angled inward toward the interior of the combustor extender 16. In an exemplary embodiment, the equivalence ratio of the rich air-fuel mixture 44 may be controlled by a width 50 of the outlet 48, which determines the volume of the air flow 40 that is mixed within the air-fuel mixture 44 directed into the hot combustion gas 60 in the combustor extender 16. For example, an increase in the width 50 of the outlet 48 would increase the volume of the air flow 40 that is mixed within the air-fuel mixture 44, and thus decrease the equivalence ratio of the rich air-fuel mixture 44 directed into the combustor extender 16. In another exemplary embodiment, the equivalence ratio of the rich air-fuel mixture 44 may be controlled by a width of the second opening 38 that is configured to receive the air flow 40.

As previously discussed, a portion of the air flow 40 is mixed with fuel from the fuel stages 19 to produce the lean air-fuel mixture 58 that is combusted at the first stage 21 in the combustor. Also, as previously discussed, a portion of the air flow 40 is mixed with fuel 36 directed from the fuel supply line 24 to the fuel manifold 28, to produce the rich air-fuel mixture 44. A split of the total amount of air used between the lean air-fuel mixture 58 and the rich air-fuel mixture 44 is between 0.5% and 3.5% of the total air flow in the rich air-fuel mixture 44. Additionally, a split of the total amount of fuel used between the lean air-fuel mixture 58 and the rich air-fuel mixture 44 is between 5% and 20% of the total air flow in the rich air-fuel mixture 44. In an exemplary embodiment, the split of the total amount of air is between 0.5% and 2% in the rich air-fuel mixture 44, for example. In an exemplary embodiment, the split of the total fuel is between 5% and 15% in the rich air-fuel mixture 44, for example.

Figure 4:
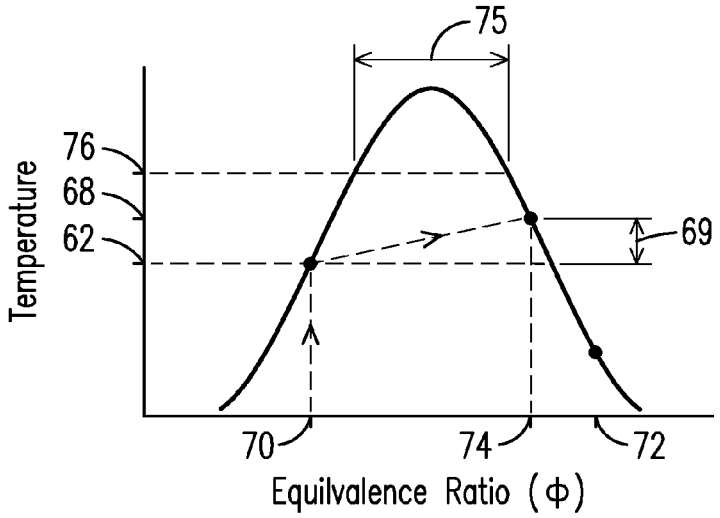
FIG. 4 is a plot of temperature of combustion gas versus Phi for the hot combustion gas used within the axial stage combustion arrangement of FIG. 2.

FIG. 4 illustrates a plot of a temperature of the hot combustion gas versus the equivalence ratio of an ignited air-fuel mixture to generate the hot combustion gas at the temperature. As illustrated in FIG. 4, if the temperature of the hot combustion gas within the combustor 12/combustor extender 16 exceeds an emission threshold temperature 76, an impermissible level of NOx emissions will be generated. As further illustrated in FIG. 4, the temperature of the hot combustion gas exceeds the emission threshold temperature 76 when the equivalence ratio of the ignited air-fuel mixture is within an equivalence ratio range 75. In an exemplary embodiment, the equivalence ratio range 75 is centered on an equivalence ratio of 1, since ignition of an air-fuel mixture having an equivalence ratio of 1 results in a maximum temperature of the hot combustion gas.

FIG. 4 illustrates the equivalence ratio 70 of the lean air-fuel mixture 58 that is ignited at the first stage 21 of combustion in the combustor 12, which generates the hot combustion gas 60 with the first temperature 62. As previously discussed, the equivalence ratio 70 is less than 1 and in one example may be approximately 0.6, for example. FIG. 4 illustrates that the equivalence ratio 70 lies outside the equivalence ratio range 75, and thus the first temperature 62 of the hot combustion gas 60 is less than the emission threshold temperature 76. FIG. 4 further illustrates the equivalence ratio 72 of the rich air-fuel mixture 44 that is injected into the hot combustion gas 60 at the second stage 66 of combustion within the combustor extender 16. As previously discussed, in an exemplary embodiment, the equivalence ratio 72 is selected to be within a range between 3 and 10, and in another exemplary embodiment, the equivalence ratio 72 is selected to be within a range between 3 and 5, for example. Upon injecting the rich air-fuel mixture 44 into the hot combustion gas 60 at the second stage 66, the rich air-fuel mixture 44 combines with the hot combustion gas 60 and is somewhat diluted, and thus the equivalence ratio 72 is reduced to an equivalence ratio 74 of the combined rich air-fuel mixture 44 and the hot combustion gas 60. The first temperature 62 of the hot combustion gas 60 exceeds an autoignition temperature of the rich air-fuel mixture 44, such that the rich air-fuel mixture 44 is ignited within the hot combustion gas 60. As illustrated in FIG. 4, the equivalence ratio 74 of the combined rich air-fuel mixture 44 and the hot combustion gas 60 is sufficient to elevate the first temperature 62 of the hot combustion gas 60 to a second temperature 68. Additionally, as illustrated in FIG. 4, as with the equivalence ratio 70, the equivalence ratio 74 lies outside the equivalence ratio range 75 and thus the second temperature 68 is less than the emission threshold temperature 76. In an exemplary embodiment, the first temperature 62 is a temperature within a range of 1300-1500° C., while the second temperature 68 is a temperature within a range of 1500-1700° C., such that the ignition of the rich air-fuel mixture 44 causes a change in temperature 69 of the hot combustion gas 60 by approximately 200° C., for example.

Traditional practice would suggest that a rich mixture should not be used in a secondary axial stage because of the possibility of unburnt hydrocarbons passing into the exhaust, and thus lean-lean combustion has been used for gas turbine engines in the prior art. However, the present inventors have recognized that such lean-lean arrangements are prone to produce more NOx than desired when temperatures approaching a NOx production limit 76 are targeted. Furthermore, the inventors have recognized that in order to approach a final temperature close to temperature 76 without experiencing any combustion within the undesirable range 75, it is preferable to inject a rich secondary mixture into the hot combustion gas 60 rather than a lean secondary mixture because of the dilution and mixing of the secondary mixture that will occur with the hot combustion gas 60. As illustrated in FIG. 4, the secondary mixture 44 is injected at an equivalence ratio 72, but it then dilutes and combusts at equivalence ratio 68. However, at least some localized combustion occurs at the perimeter of the injected mixture during the dilution process, and that localized combustion occurs at equivalence ratios between 72 and 74 as the ratio gradually decreases on a bulk basis. In order to achieve a final temperature of 68 with a lean secondary mixture, it would be necessary to inject the secondary mixture at an equivalence ratio that falls within the undesirable range 75, such that its dilution would result in bulk combustion on the lean side of range 75 and at a temperature close to 76. However, the inventors have recognized that there is at least some localized combustion within the undesirable range 75 as the bulk lean mixture is diluted, thereby generating undesirable NOx gasses. Accordingly, the present invention utilizes a rich secondary mixture rather than a lean secondary mixture to achieve the desired temperature 68, thereby minimizing NOx production, and unexpectedly also minimizing unburnt hydrocarbon emissions due to the high temperature and high free radical content of the primary combustion gas 60, During the combustion of the rich air-fuel mixture 44, the first temperature 62 and free radicals within the hot combustion gas 60 combusts the rich air-fuel mixture 44 such that a level of hydrocarbons within the hot combustion gas 60 are maintained within a predetermined hydrocarbon limit. Additionally, the ignition of the lean air-fuel mixture 58 at the first stage 21 generates a first degree of emissions in the hot combustion gas 60, and the ignition of the rich air-fuel mixture 44 within the hot combustion gas 60 increases the first degree to a second degree of emissions, such that the second degree of emissions is within a predetermined emissions limit. In an exemplary embodiment, the emissions are NOx, the first degree of NOx in the hot combustion gas 60 is 35 PPM and the second degree of NOx in the hot combustion gas 60 is 50 PPM, which is less than a predetermined NOx limit, for example.

Figure 5:
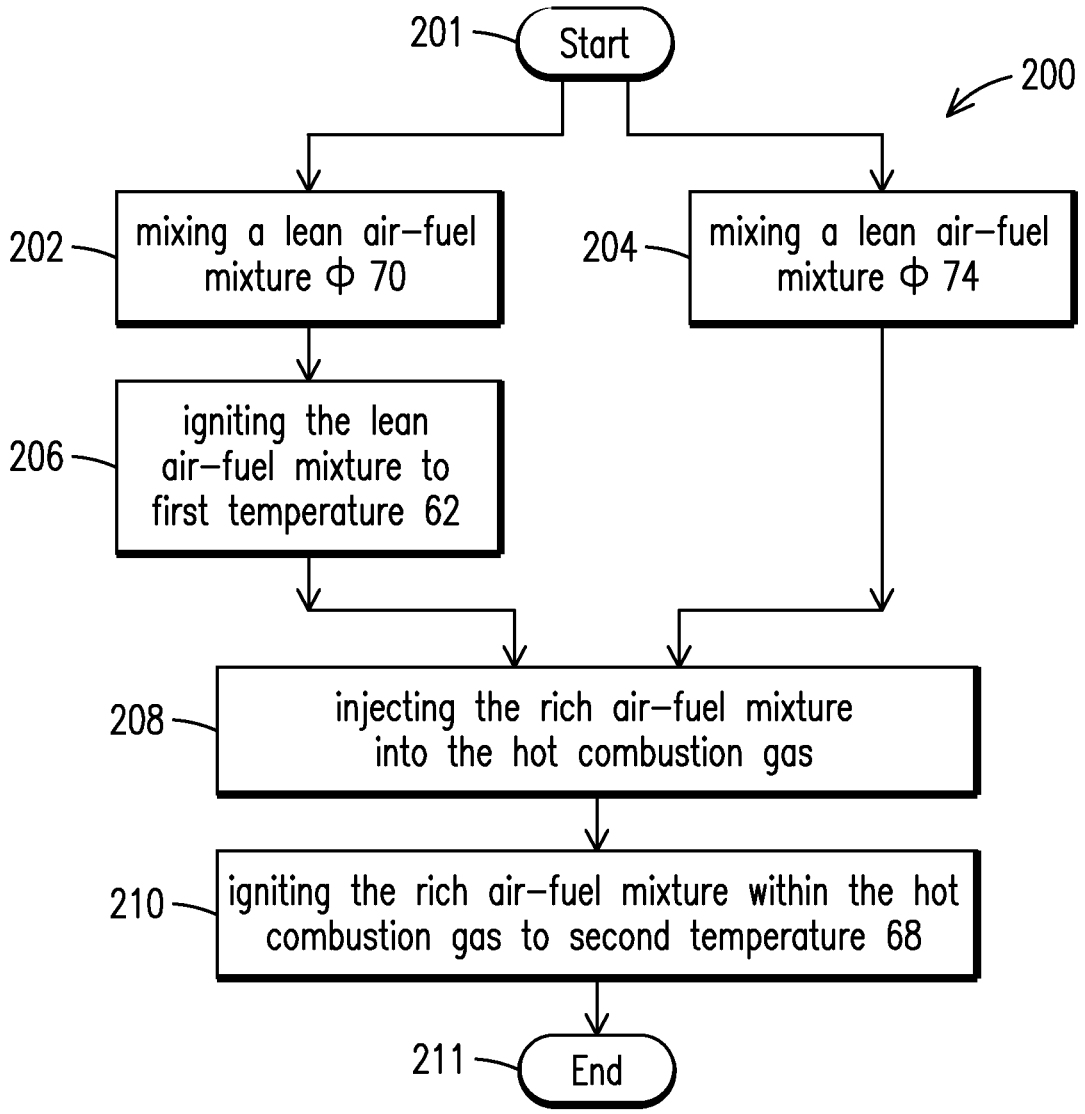
FIG. 5 is a flowchart depicting a method for axial stage combustion in a gas turbine engine.

FIG. 5 illustrates a flowchart to depict a method 200 for axial stage combustion in the gas turbine engine 10. The method 200 begins at 201 by mixing 202 the lean air-fuel mixture 58 in the first stage 21 of combustion of the can-annular combustor 12 of the gas turbine engine 10, where the lean air-fuel mixture 58 has the equivalence ratio 70 shown in FIG. 4. The method 200 further includes mixing 204 the rich air-fuel mixture 44 with the equivalence ratio 72 shown in FIG. 4. The method 200 further includes igniting 206 the lean air-fuel mixture 58 at the first stage 21 of combustion to create hot combustion gas 60 with the first temperature 62 (FIG. 4) and free radicals. The method 200 further includes injecting 208 the rich air-fuel mixture 44 into the hot combustion gas 60 at the second stage 66 of combustion of the can-annular combustor 12 downstream from the first stage 21. The method 200 further includes igniting 210 the rich air-fuel mixture 44 in the hot combustion gas 60 at the second stage 66 of combustion, such that the first temperature 62 and the free radicals of the hot combustion gas 60 combusts the rich air-fuel mixture 44 within a predetermined hydrocarbon limit and the first temperature 62 of the hot combustion gas increases to the second temperature 68 (FIG. 4), before ending at 211. Additionally, the method 500 may be modified, such that the igniting step 206 is performed, so that the first temperature 62 is below a predetermined NOx production threshold limit, for example. Additionally, the method 500 may be modified, such that the mixing 204 step is for the rich air-fuel mixture 44 to have an equivalence ratio greater than or equal to three. Additionally, the method 500 may be modified, to include utilizing heat of the hot combustion gas 60 and free radicals therein to ignite the rich air-fuel mixture 44 during the igniting 210 step, such that the rich air-fuel mixture 44 is combusted within a predetermined hydrocarbon emissions limit and the temperature of the hot combustion gas is increased by a threshold amount to a temperature still below the NOx production threshold limit.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A method for axial stage combustion in a gas turbine engine comprising:

mixing air and fuel to form a lean air-fuel mixture of air and fuel in a first stage of combustion of a can-annular combustor of the gas turbine engine, wherein the lean air-fuel mixture of air and fuel has an equivalence ratio of less than one;

igniting the lean air-fuel mixture at the first stage of combustion to create hot combustion gas having a first temperature and free radicals;

disposing an air-fuel mixing arrangement in a second stage of combustion of the can-annular combustor, the second stage of combustion located downstream from the first stage of combustion, the air-fuel mixing arrangement coupled to receive fuel delivered in the second stage of combustion by a plurality of fuel nozzles and further coupled to receive a flow of air in the second stage of combustion;

mixing air and fuel received by the air-fuel mixing arrangement to form a rich air-fuel mixture of air and fuel in the second stage of combustion, wherein the rich air-fuel mixture of air and fuel has an equivalence ratio of greater than one;

wherein the mixing of air and fuel received by the air-fuel mixing arrangement comprises adjustably varying a volumetric flow rate of fuel delivered in the second stage of combustion by the fuel nozzles by way of respective valves in each fuel nozzle to adjustably vary the equivalence ratio of the rich air-fuel mixture, injecting the rich air-fuel mixture into the second stage of combustion; and igniting the rich air-fuel mixture in the hot combustion gas at the second stage of combustion, such that the first temperature and the free radicals of the hot combustion gas promote combustion of the rich air-fuel mixture within a predetermined hydrocarbon emissions limit, and the first temperature of the hot combustion gas increases to a second temperature.

2. The method of claim 1, wherein the rich air-fuel mixture has an equivalence ratio between 3 and 10.

3. The method of claim 2, wherein the rich air-fuel mixture has an equivalence ratio between 3 and 5.

4. The method of claim 1, wherein the equivalence ratio of the rich air-fuel mixture is reduced as it diffuses into the hot combustion gas so that when the rich air-fuel mixture is diffused into the hot combustion gas, the second temperature is less than an emission threshold temperature.

5. The method of claim 1, wherein a split of a total amount of air between the lean air-fuel mixture and the rich air-fuel mixture is between 0.5% and 3.5% in the rich air-fuel mixture; and wherein a split of a total amount of fuel between the lean air-fuel mixture and the rich air-fuel mixture is between 5% and 20% in the rich air-fuel mixture.

6. The method of claim 5, wherein the split of the total amount of air is between 0.5 and 2% in the rich air-fuel mixture and wherein the split of the total amount of fuel is between 5 and 15% in the rich air-fuel mixture.

7. A method for axial stage combustion in a gas turbine engine comprising:

mixing a lean air-fuel mixture in a first stage of combustion of a can-annular combustor of the gas turbine engine, wherein the lean air-fuel mixture has an equivalence ratio of less than one;

igniting the lean air-fuel mixture at the first stage of combustion to create hot combustion gas having a first temperature and free radicals;

mixing a rich air-fuel mixture with an equivalence ratio of greater than one;

injecting the rich air-fuel mixture into the hot combustion gas at a second stage of combustion of the can-annular combustor downstream from the first stage; and igniting the rich air-fuel mixture in the hot combustion gas at the second stage of combustion, such that the first temperature and the free radicals of the hot combustion gas promote combustion of the rich air-fuel mixture within a predetermined hydrocarbon emissions limit, and the first temperature of the hot combustion gas increases to a second temperature, wherein the first temperature is in a range of 1300-1500 degrees C. and wherein the second temperature is in a range of 1500-1700 degrees C.

8. The method of claim 1, wherein the igniting of the lean air-fuel mixture generates a first degree of an emission in the hot combustion gas, wherein the igniting of the rich air-fuel mixture increases the first degree of the emission to a second degree of the emission, and wherein the second degree of the emission is within a predetermined emission limit.

9. The method of claim 8, wherein the emission comprises NOx.

10. A gas turbine engine comprising:

a can-annular combustor comprising a first stage of combustion, wherein air and fuel are mixed to form a lean air-fuel mixture of air and fuel, wherein the lean air-fuel mixture has an equivalence ratio of less than one wherein ignition of the lean air-fuel mixture forms hot combustion gas having a first temperature and free radicals;

a transition in fluid communication between the combustor and a turbine;

a combustor extender in fluid communication between the combustor and the transition;

a plurality of wall openings formed through the combustor extender;

a fuel manifold extending along an outer surface of the combustor extender, said fuel manifold comprising a plurality of fuel nozzles aligned to deliver fuel through the respective plurality of wall openings; and an air-fuel mixing arrangement disposed in a second stage of combustion the air-fuel mixing arrangement coupled to receive fuel delivered by the plurality of fuel nozzles and further coupled to receive a flow of air to form a rich air-fuel mixture of air and fuel with an equivalence ratio of greater than one, wherein the second stage of combustion is disposed downstream from the first stage of combustion, wherein the air-fuel mixing arrangement supplies the rich air-fuel mixture, wherein the rich air-fuel mixture is ignited in the hot combustion gas, such that the first temperature and the free radicals of the hot combustion gas promote combustion of the rich air-fuel mixture within a predetermined hydrocarbon emissions limit, and the first temperature of the hot combustion gas increases to a second temperature, wherein the air-fuel mixing arrangement comprises:

a mixer positioned between the fuel manifold and the outer surface of the combustor extender at each of the plurality of openings, said mixer including a first opening aligned with the respective fuel nozzle to receive fuel from the respective fuel nozzle and a second opening to receive the air flow; and a scoop positioned at each of the plurality of openings said scoop configured to receive the fuel and the air flow from the mixer, said scoop is further configured to direct the rich air-fuel mixture of the fuel and the air flow into the respective opening, wherein each fuel nozzle of the fuel manifold includes a valve to adjustably vary a volumetric flow rate of fuel directed into the first opening and to adjustably vary an equivalence ratio of the air-fuel mixture directed into the respective opening.

11. A gas turbine engine comprising:

a can-annular combustor comprising a first stage of combustion, wherein air and fuel are mixed to form a lean air-fuel mixture of air and fuel, wherein the lean air-fuel mixture has an equivalence ratio of less than one, wherein ignition of the lean air-fuel mixture forms hot combustion gas having a first temperature and free radicals;

a transition in fluid communication between the combustor and a turbine;

a combustor extender in fluid communication between the combustor and the transition;

a plurality of wall openings formed through the combustor extender;

a fuel manifold extending along an outer surface of the combustor extender, said fuel manifold comprising a plurality of fuel nozzles aligned to deliver further fuel through the respective plurality of wall openings; and an air-fuel mixing arrangement disposed in a second stage of combustion, the air-fuel mixing arrangement coupled to receive the further fuel delivered by the plurality of fuel nozzles and further coupled to receive a flow of air to form in the second stage of combustion a rich air-fuel mixture of air and fuel with an equivalence ratio of greater than one, wherein the second stage of combustion is disposed downstream from the first stage of combustion wherein the air-fuel mixing arrangement supplies the rich air-fuel mixture wherein the rich air-fuel mixture is ignited in the hot combustion gas, such that the first temperature and the free radicals of the hot combustion gas promote combustion of the rich air-fuel mixture within a predetermined hydrocarbon emissions limit, and the first temperature of the hot combustion gas increases to a second temperature, wherein the first temperature is in a range of 1300-1500 degrees C. and wherein the second temperature is in a range of 1500-1700 degrees C.

12. The gas turbine engine of claim 11, wherein the air-fuel mixing arrangement comprises:

a mixer positioned between the fuel manifold and the outer surface of the combustor extender at each of the plurality of openings, said mixer including a first opening aligned with the respective fuel nozzle to receive fuel from the respective fuel nozzle and a second opening to receive the air flow; and a scoop positioned at each of the plurality of openings, said scoop configured to receive the fuel and the air flow from the mixer, said scoop is further configured to direct the rich air-fuel mixture of the fuel and the air flow into the respective opening.

13. The gas turbine engine of claim 12, wherein the second opening of the mixer is an annular opening to receive the air flow and wherein the first opening is formed in a central cross sectional region of the mixer.

14. The gas turbine engine of claim 12, wherein the scoop takes a conical shape that is angled inward toward an interior of the combustor extender.

15. The gas turbine engine of claim 11, wherein the plurality of openings are formed along an outer circumference of the outer surface of the combustor extender and wherein the fuel manifold is configured to extend along the outer circumference of the outer surface of the combustor extender.

16. The gas turbine engine of claim 11, further comprising:

a sleeve around an outer surface of the combustor, said sleeve including a supply line to direct fuel to the fuel manifold;

a controller to supply fuel through the supply line to the fuel manifold, based on a load of the gas turbine engine exceeding a threshold load.

17. The gas turbine engine of claim 11, wherein the plurality of openings formed through the combustor extender are oval shaped.

18. A method for axial stage combustion in a gas turbine engine comprising:

mixing air and fuel to form a lean air-fuel mixture of air and fuel in a first stage of combustion;

igniting the lean air-fuel mixture at the first stage of combustion of the gas turbine engine to create hot combustion gas having a temperature below a predetermined NOx production threshold limit;

mixing further air and fuel to form a rich air-fuel mixture of air and fuel with an equivalence ratio of air and fuel greater than or equal to three;

injecting the rich air-fuel mixture into the hot combustion gas at a second stage of combustion downstream from the first stage; and utilizing heat of the hot combustion gas and free radicals therein to ignite the rich air-fuel mixture such that the rich air-fuel mixture of air and fuel is combusted within a predetermined hydrocarbon emissions limit and the temperature of the hot combustion gas is increased by a threshold amount to a temperature still below the NOx production threshold limit, wherein the temperature of the hot combustion gas is increased from within a range of 1300-1500 degrees C to within a range of 1500-1700 degrees C.

19. A method for axial stage combustion in a gas turbine engine comprising:

igniting a lean air-fuel mixture at a first stage of combustion of the gas turbine engine to create hot combustion gas having a temperature below a predetermined NOx production threshold limit;

mixing a rich air-fuel mixture with an equivalence ratio greater than or equal to three;

injecting the rich air-fuel mixture into the hot combustion gas at a second stage of combustion downstream from the first stage; and utilizing heat of the hot combustion gas and free radicals therein to ignite the rich air-fuel mixture such that the rich air-fuel mixture is combusted within a predetermined hydrocarbon emissions limit and the temperature of the hot combustion gas is increased by a threshold amount to a temperature still below the NOx production threshold limit, wherein the temperature of the hot combustion gas is increased from within a range of 1300-1500 degrees C. to within a range of 1500-1700 degrees C.

* * * * *